United States Patent [19]

Brydon

[11] 4,205,038

[45] May 27, 1980

[54] PROCESS FOR PRODUCING SHAPED ARTICLES OF POLYOXADIAZOLES

[75] Inventor: Donald L. Brydon, Harrogate, England

[73] Assignee: Imperial Chemical Industries Limited, London, England

[21] Appl. No.: 748,917

[22] Filed: Dec. 9, 1976

Related U.S. Application Data

[63] Continuation-in-part of Ser. No. 610,843, Sep. 5, 1975, Pat. No. 4,035,465.

[51] Int. Cl.[2] ..... D01D 5/12

[52] U.S. Cl. ..... 264/184; 264/289.3; 264/210.7

[58] Field of Search ..... 266/184, 210 F; 260/78.41

[56] References Cited

U.S. PATENT DOCUMENTS

| | | | |
|---|---|---|---|
| 3,966,686 | 6/1976 | Asakara et al. | 264/184 |
| 3,993,625 | 11/1976 | Kuvihara et al. | 260/78.41 |
| 4,035,465 | 7/1977 | Brydon | 264/184 |
| 4,046,731 | 9/1977 | Mortimer et al. | 260/78.41 |

FOREIGN PATENT DOCUMENTS

| | | | |
|---|---|---|---|
| 2257707 | 5/1973 | Fed. Rep. of Germany | 264/184 |
| 2541482 | 3/1976 | Fed. Rep. of Germany | 264/184 |

*Primary Examiner*—Jay H. Woo

*Attorney, Agent, or Firm*—Andrew F. Sayko, Jr.

[57] ABSTRACT

A method of making a drawn filament from a hot drawable poly-phenylene-1,3,4-oxadiazole having p-phenylene radicals or p- and m-phenylene radicals, with substituted bromine, wherein a solution of the polymer is dry jet wet spun into a coagulant, and the undrawn filament stretched at least 6 times, at least two times at a temperature of at least 350° C.

12 Claims, No Drawings

PROCESS FOR PRODUCING SHAPED ARTICLES OF POLYOXADIAZOLES

This application is a continuation-in-part of U.S. application Ser. No. 610,843 filed Sept. 5, 1975 now U.S. Pat. No. 4,035,465.

The present invention relates to a method for the production of a drawn filament of poly-phenylene-1,3,4-oxadiazole.

Filaments of poly-phenylene-1,3,4-oxadiazole are known. They are very heat stable and have been considered as being suitable for high performance end uses, e.g. tyre cords, if it were possible to make them with sufficiently good properties. The drawing of this type of filament has been described. One method which has been described consists in drawing the filament in hot water from 2 to 7 times its length, but the resulting mechanical properties were low. High values of mechanical properties have been claimed, but the method used relied on the use of a very toxic and expensive coagulant in the spinning method, an initial drawing in hot water at a draw ratio 2:1 to 3:1 and a secondary drawing in an inert gas at 300° C. to 400° C. at a draw ratio of 1:1 to 1.8:1. Thus, until now it has not proved possible to produce a drawn filament of poly-phenylene-1,3,4-oxadiazols by hot drawing at high temperatures and high draw ratios.

Accordingly, the present invention provides a method for the production of a drawn filament of poly-phenylene-1,3,4-oxadiazole, which comprises extruding through a shaped orifice a solution of the polymer in oleum or sulphuric acid, the polymer having as characteristic units

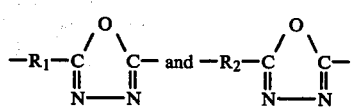

in which $R_1$ is a p-phenylene radical and p1 $R_2$ is a m-phenylene radical, the ratio of $R_1$ radicals and $R_2$ radicals lying within the range 100/0 to 50/50, at least some of the phenylene radicals being bromine substituted in a position ortho to the heterocyclic ring, the bromine content of the polymer being at least T/6%, where T is the mole percent of p-phenylene radicals, passing the extruded polymer solution through a gaseous medium for a short distance, and then into an aqueous coagulant to form an undrawn filament of the polymer, and stretching the undrawn filament at least six times its length, the filament being stretched at least two times while heated to a temperature of at least 350° C. Preferably the filament is stretched at least two times while heated to a temperature of at least 400° C. which temperature is below the thermal decomposition temperature of the polymer. Desirably the bromine content of the polymer is at least (T/5)+5%.

In this specification, stretching the filament at least two times while heated to a temperature of at least 350° C. will be referred to as hot drawing.

The filament may be stretched in a single operation, in which case the filament is drawn at least six times while heated to a temperature of at least 350° C. Alternatively, the filament may be stretched in a plurality of operations, one of which, which is normally the last in the sequence, comprises drawing the filament at least two times while heated to a temperature of at least 350° C. Suitable stretching operations include the stretching of the filament after withdrawal from the coagulant but before being dried, that is, whilst the filament is in a wet or never dried state. The stretching may take place, for example, before or whilst the coagulated filament is being washed to remove residual solvent and any component absorbed from the aqueous coagulant, or, preferably, as a separate operation after the filament has been washed. Stretching the filament whilst wet tends to remove water from the filament, so that less drying is required prior to the hot drawing operation. In addition, the wet stretching tends to give more uniform drawing in subsequent drawing operations by reducing or even eliminating any tendency for spontaneous elongation of the dried yarn on heating.

Stretching of the filament may also take place after the filament has been dried, provided that the temperature of the filament during the stretching operation is below the glass transition temperature (Tg) of the filament. The stretch ratio employed in stretching the filament whilst in the wet state or after drying may be 1:1, or any value upto and including the maximum value attainable. The maximum value attainable will be a function of the polymer composition, that is the ratio of $R_1$ radicals and $R_2$ radicals, and also the degree of bromination.

The filament may be dried by passing it, for example, through a blanket of hot air or over a heated roll. Preferably, the drying of the filament immediately precedes the stretching of the filament below its Tg temperature and/or drawing at a temperature of at least 350° C. In the case where the filament is drawn at a temperature of at least 350° C. immediately after drying, the preferred drying process consists of passing the filament over and in contact with a heated surface at a temperature in the range 140° C. to 300° C., preferably 210° C. to 270° C.

Conveniently, the heated surface is constituted by the peripheral surface of a roll about which the filament is wrapped, and this roll may be the feed roll of the drawing stage. The filament may be heated to the drawing temperature by passing it over and in contact with a hot plate positioned between the feed roll and the draw roll of the drawing stage.

The draw ratio employed in the hot drawing stage will vary depending upon the stretch ratio used in the wet stretching and dry stretching operations, if used. However, it is essential that the combination of any wet stretching and/or dry stretching with the hot drawing results in a total elongation of the undrawn filament at least 6 times. Thus, in the case where the wet stretch and dry stretch ratios are 1:1, the hot draw ratio must be at least 6:1. However, when the wet stretch and/or dry stretch ratio is greater than 1:1, the hot draw ratio may be less than 6:1. Preferably the total stretch given to the filament is or is near to the maximum attainable in order that the resultant filament has good tensile properties.

In addition to the stretching given to the filament after its withdrawal from the coagulant; the filament may, if desired, be subjected to spin stretch, ie. stretching in the aqueous coagulant by making the rate of withdrawal therefrom greater than the rate of extrusion from the shaped orifice. Where a filament is subjected to spin stretch, the extent of spin stretch is not taken into account in determining the total stretch given to the undrawn filament.

The polymer solution is conveniently heated prior to and during extrusion. A temperature in the range 70° C. to 225° C. for the polymer solution may be used, preferably a temperature 80°0 C. to 200° C. The temperature selected is that which provides for a suitable solution viscosity for a given polymer concentration in the solution, and at which, for the extrusion conditions being used, does not produce the undesirable "Tordella" effect [J. Appl. Phys. 27,254, (1956)]. The polymer is extruded in solution in oleum directly, or the solution may be treated by the addition of water or steam, the latter being preferred, to reduce the concentration of the oleum to 100% sulphuric acid or less prior to extrusion.

The filament may be spun from a solution having a polymer concentration in the range 1% to 20% by weight, preferably 7% to 20% by weight. The polymer has an inherent viscosity greater than 1.0, and preferably greater than 2.0, as measured at 25° C. as a 0.5% solution in 98% sulphuric acid.

The polymer solution is pun to form a single filament or a plurality of filaments. The or each extrusion orifice is positioned above the aqueous coagulant, and the polymer solution is extruded downwardly by being forced through the or each orifice to form a stream of the polymer solution which is passed through a gaseous medium, usually comprising air, for a short distance before it enters the aqueous coagulant. The distance travelled by the polymer stream through the gaseous medium is usually from 0.3 cm to 3.8 cms. and preferably is 1.0 cm. However, the optimum distance is readily ascertainable, and depends on viscosity, concentration, temperature and other spinning solution conditions.

The aqueous coagulant may be water, or most preferably, aqueous sulphuric acid, and its temperature may be varied as desired above and below ambient temperature (i.e. about 12° C.). Additives for physically and/or chemically modifying the properties of the filament, or the action of the aqueous coagulant, may be used in the coagulation bath. The extruded stream of polymer solution may be fed into a dynamic coagulant system, e.g. one wherein the coagulant flows through a tube and the stream of polymer solution passes through the tube in intimate contact with the coagulant. Additionally, or alternatively, the extruded stream of polymer solution may be fed into a static coagulant system, e.g. one wherein the coagulant is contained within a bath and through which the extruded stream of polymer solution is passed. The thus-formed filament is withdrawn from the aqueous coagulant and washed. Washing may be effected by passing the filament through one or more water baths, in which the water is heated, to remove solvent and coagulant.

The filament is formed of an oxadiazole polymer containing the characterising units $R_1$ radicals only, or $R_1$ radicals and $R_2$ radicals, and in which the $R_1$ and/or the $R_2$ radicals have been bromine substituted. In order for the filament to be hot drawable according to the invention it is necessary that at least some of the $R_1$ and/or $R_2$ radicals have the bromine substituted in a position which is ortho relative to the heterocyclic, i.e. oxadiazole, ring. Preferred polymers are based on terephthalic acid alone, or preferably on mixtures of terephthalic acid and isophthalic acid, which are polymerised with a hydrazine salt, especially hydrazine sulphate, in oleum of from 5% to 65% strength, preferably 20% to 40% strength. Bromination may be effected by adding bromine to the polymer in solution in oleum, or using brominated acid(s), or a mixture of brominated acids and unbrominated acids. The acids may be dissolved in the oleum before addition of the hydrazine derivative.

The preferred polymer for making the filament of the invention has a ratio of $R_1$ radicals to $R_2$ radicals in the range 95/5 to 70/30, because in this range the drawn filament has extremely good mechanical properties. Most desirably, the bromine content of the polymer is at least 15% by weight.

The invention will be further described with reference to the following Examples in which parts are by weight unles otherwise indicated. In Examples 1 to 23, the filaments were not stretched whilst in the wet state, or between drying and hot drawing. In these Examples, the only stretching applied to the filaments was while they were heated to a temperature of at least 350° C. The temperature at which the maximum draw ratio was attained was determined using different temperatures at a feed speed of 6 meters per minute, at each of which the draw ratio was increased in steps of 0.5 until drawing was no longer possible.

EXAMPLE 1

Terephthalic acid (166.2 parts) was dissolved in oleum (2320 parts) of 35% strength at 85° C. and then bromine (68.6 parts) was added dropwise over 4 hours to the stirred, heated solution which was protected from atmospheric moisture by a silica drying tube on top of a water condenser. After a further hour, when the bromine had reacted with the terephthalic acid in the heated stirred solution, the source of heat was removed and the reaction flask was flushed for a short time with compressed air to remove any residual traces of bromine.

Isophthalic acid (166.2 parts) and hydrazine sulphate (273.2 parts) were added to the solution of brominated terephthalic acid at room temperature and this reaction mixture was then heated for 4 hours at 130° C. with stirring to give a viscous solution.

The resultant polymer solution was diluted to a polymer concentration of 8% by weight with 100% sulphuric acid at 100° C., and the diluted solution was used as a spinning dope. Polymer isolated from the dope had a bromine content of 16% and an inherent viscosity of 2.38.

Following degassing, the dope was dry-jet wet spun at 110° C. through a ten-hole spinneret (each hole being 200μ diameter) with a one centimeter air gap into water at 12° C. and wound up with a spin stretch factor of 1.01. The spinning temperature was chosen to be 10° C. higher than the extrusion flow instability temperature. The spun filaments were washed free of sulphuric acid and dried. The inherent viscosity of the polymer of the filaments was 2.13.

The filaments were drawn between feed rolls and draw rolls while passing over and in contact with a grooved hot plate 46 cms. in length. The temperature of maximum draw ratio was found to be 430° C. and the maximum draw ratio was 18×. At 430° C., with a feed speed of 6 meters/min. and a draw ratio of 18×, the resulting drawn filaments had the properties given in Table 1.

COMPARATIVE EXAMPLE A

In this example the bromine is substituted in the 5-position in the m-phenylene radicals only, i.e. not in a position ortho to the heterocyclic ring.

The bromination, polymerisation and spinning dope preparation were as described in Example 1, except that the isophthalic acid was dissolved in oleum and brominated, and the terephthalic acid, together with hydrazine sulphate, subsequently added. Polymer isolated from the spinning dope had a bromine content of 14.25% and an inherent viscosity of 2.14.

The spinning, washing and drying steps were as described in Example 1, except that the spinning temperature was 150° C. and the spin stretch factor was 0.99. The inherent viscosity of the polymer of the spun filaments was 2.14.

The filaments were drawn between feed rolls and draw rolls while passing over and in contact with a grooved hot plate 46 cms. in length. The temperature of maximum draw ratio was found to be 540° C. and the maximum draw ratio was 5×. Drawing under these conditions, at a feed speed of 6 meters/min., the resulting drawn filaments and the properties given in Table 1.

EXAMPLE 2

An 8% by weight solution in 10% strength oleum of 15% brominated p-phenylene-1,3,4-oxadiazole-m-phenylene-1,3,4-oxadiazole copolymer (of inherent viscosity 2.4), prepared by the reaction of equal amounts by weight of terephthalic acid and isophthalic acid with hydrazine sulphate in oleum and subsequent bromination of the resultant polymer solution, was degassed and dry-jet wet spun by the method according to Example 1 with a spin stretch factor of 1.0. The inherent viscosity of the polymer of the filaments was 2.3.

The filaments were drawn between feed rolls and draw rolls while passing over and in contact with a grooved hot-plate 46 cms in length. The temperature of maximum draw ratio was found to be 430° C. and the maximum draw ratio was 12×. Drawing under these conditions, at a feed speed of 6 meters/min., the resulting draw filaments had the properties given in Table 1.

TABLE 1

| Example | 1 | A | 2 |
|---|---|---|---|
| Tenacity (g./decitex) | 9.75 | 2.38 | 7.5 |
| % Extension | 6 | 11.8 | 7 |
| Initial Modulus (g./decitex/100% Extension) | 240 | 70 | 180 |

EXAMPLE 3

A mixture of terephthalic acid (0.25 mole), isophthalic acid (0.09 mole), 2 bromo-isophthalic acid (0.16 mole), hydrazine sulphate (0.521 mole) and 30% oleum (529.7 parts) was stirred and heated to 130°–135° C. in 1.5 hours in a reaction vessel protected from atmospheric moisture. Stirring at 130°–135° C. was continued for 3 hours and then 25% oleum (240 parts) was added gradually during the next 60 minutes and thereafter agitation at 130°–135° C. was continued for a further 60 minutes. A viscous solution was obtained. Polymer isolated from the solution contained 14.3% bromine and had an inherent viscosity of 2.5.

The solution was degassed at 130° C. under 5 mm Hg pressure and dry jet wet spun at 5 ml/min using a 10 hole 200μ diameter spinneret at 165° C. through a 1 cm air gap into water at room temperature. The coagulated fibre was washed free of acid in water at 40° C., dried on a hot chrome roll and oiled with a silicone oil to improve cohesiveness of the yarn bundle.

The dried yarn was passed at 10 m/min onto a 50 cm long hot plate at 400° C. and drawn at a maximum draw ratio of 7.

Table 2 lists the properties after spinning and hot drawing of this and other polyoxadiazoles which were prepared, spun and hot drawn by similar procedures to that given in Example 3.

TABLE 2

| | Tel-polyoxadiazole | | | Spinning | Hot Drawing | | Hot Drawn Fibre Properties | | | |
|---|---|---|---|---|---|---|---|---|---|---|
| Example | Composition (Molar Ratio) | IV | % Halogen | Temp °C. | Temp °C. | Draw Ratio | T | E | M | IV |
| 3 | TA/2-Bromo-iPA/iPA(50:32:18) | 2.5 | 14.3 | 165 | 400 | 7 | 5.5 | 6.0 | 178 | 2.0 |
| 4 | TA/2-Bromo-TA/iPA(18/32/50) | 2.7 | 14.9 | 170 | 450 | 12 | 7.6 | 6.3 | 220 | 2.0 |
| 5 | TA/4-Bromo-iPA/iPA(50/32/18) | 1.9 | 14.3 | 150 | 435 | 10 | 6.7 | 7.3 | 125 | 2.0 |

TA = Terephthalic Acid
iPA = Isophthalic Acid
T = Tenacity (g/dtex)
E = Extension (%)
M = Initial Modulus (g/decitex)
IV = Inherent Viscosity

EXAMPLE 6 AND COMPARATIVE EXAMPLE B

A mixture of terephthalic acid (3 moles), hydrazine sulphate (2.99 moles) and 30% oleum (4872.3 parts) was stirred and heated in an oil bath to 135° C. during 1.5 hours. Stirring at 135°–140° C. bath temperature was continued for 3.75 hours to give a viscous dope. Polymer isolated from the dope had an inherent viscosity of 3.3.

Iodine (catalyst; 1.0 part) was added to the cold dope which was then stirred and heated to 90°–95° C. Bromine (187.2 parts) was added, at such a rate that little or no bromine refluxed from the reflux condenser, at 90°–95° C. with stirring. Agitation at this temperature was continued until only a small amount of unreacted bromine remained and after cooling to ambient temperature the free bromine was blown off with dry nitrogen. Polymer isolated from the dope contained 20.5% bromine and had an inherent viscosity of 2.7. The polymer solutions were degassed, dry jet wet spun, washed and dried as described in Example 3 with the exception of spinning temperature which was 148° C. for the unbrominated polymer and 195° C. for the brominated polymer. Drawing conditions were the same as Example 3 with the exception of hot plate temperature and draw ratio which are given below.

The properties of fibre obtained by spinning and hot drawing unbrominated polymer (Example B) and the brominated polymer (Example 6) were:

| Example | B | 6 |
|---|---|---|
| Tenacity (g/decitex) | 4.1 | 6.6 |
| Extension (%) | 4.3 | 2.6 |

-continued

| Example | B | 6 |
|---|---|---|
| Initial modulus (g/decitex) | 162 | 272 |
| Maximum Draw Ratio | 3 | 6.5 |
| Drawing Temperature | 425 | 520 |

Other brominated polyoxadiazole dopes prepared by a similar procedure to that given in Example 6 are listed in Table 3. The molar quantities of hydrazine sulphate used, for a total of 3 moles of terephthalic and isophthalic acids; and iodine and bromine usages are given for the preparation of the individual polyoxadiazoles. Table 3 also gives the properties of hot drawn fibres obtained by spinning the dopes at the indicated temperatures and hot drawing the resultant fibres at the indicated temperatures and draw ratio. Spinning and hot drawing were carried out by similar methods to those described in Example 3.

TABLE 3

| Example | Brominated Polyoxadiazole Composition TA/iPA(mole) % | Polymer Preparation Usage of HS (moles) | $I_2$ (g) | $Br_2$ (g) | Polymer Analysis IV | % Br | Spinning Temp °C. | Hot Drawing Temp. °C. | Draw Ratio | Hot Drawn Fibre Properties T | E | M | IV |
|---|---|---|---|---|---|---|---|---|---|---|---|---|---|
| 7 | 98/2 | 2.99 | 1.0 | 174.7 | 2.9 | 22.0 | 190 | 520 | 6 | 6.6 | 5.8 | 260 | 2.0 |
| 8 | 95/5 | 2.99 | 1.0 | 174.7 | 2.5 | 21.6 | 190 | 512 | 7 | 6.9 | 3.6 | 280 | 2.2 |
| 9 | 90/10 | 2.997 | 0.75 | 159.1 | 2.3 | 21.3 | 192 | 495 | 7 | 7.0 | 4.0 | 255 | 2.2 |
| 10 | 80/20 | 3.0 | 0.75 | 152.9 | 2.5 | 21.9 | 190 | 455 | 10 | 9.3 | 5.4 | 265 | 2.2 |
| 11 | 70/30 | 3.006 | 1.0 | 137.3 | 2.8 | 20.1 | 170 | 455 | 16 | 8.6 | 7.5 | 325 | 2.5 |
| 12 | 60/40 | 3.015 | 0.75 | 109.9 | 2.5 | 16.4 | 178 | 430 | 16 | 6.7 | 6.5 | 220 | 2.2 |
| 13 | 60/40 | 3.018 | 0.75 | 137.3 | 2.7 | 20.8 | 190 | 420 | 14 | 7.5 | 7.6 | 250 | 2.4 |
| Comparative C | 40/60 | 3.036 | 0.75 | 68.6 | 2.7 | 10.9 | 187 | 445 | 16 | 6.8 | 11.0 | 150 | 2.4 |
| Comparative D | 30/70 | 3.036 | 0.5 | 68.6 | 2.6 | 10.7 | 176 | 460 | 20 | 7.0 | 9.0 | 128 | 2.3 |

TA = Terephthalic acid
iPA = Isophthalic acid
HS = Hydrazine sulphate
IV = Inherent Viscosity
T = Tenacity (g/decitex)
E = Extension (%)
M = Initial Modulus (g/decitex)

EXAMPLE 14

Terephthalic acid (2.7 moles) was dissolved in 35% oleum (3414 parts) at 90° C. in a flask protected from atmospheric moisture. Iodine (catalyst; 0.75 part) was added and then bromine (159.1 parts) was added gradually (at such a rate that little or no bromine refluxed from the reflux condenser) during 12 hours whilst stirring at 90°-95° C. was continued until most of the bromine had reacted (approximately 4 hours). The bromination mixture was allowed to cool to ambient temperature and any residual free bromine which remained was blown off with dry nitrogen. Isophthalic acid (0.3 mole) and hydrazine sulphate (3.12 moles) were added to the suspension of brominated terephthalic acid in oleum at ambient temperature and the mixture was stirred and heated to 130°-135° C. in 1.5 hours. Agitation was continued at approximately 135° C. for 3 hours and then 21.4% oleum (1442 parts) was added in a fine stream during the next 1 hour. Agitation was continued at about 135° C. for a further 1.5 hours to give a viscous dope. Polymer isolated from the dope was found to contain 22% bromine and had an inherent viscosity of 1.86. The solution was degassed, dry jet wet spun, washed and dried as described in Example 3 with the exception of spinning temperature which was 90° C. Drawing conditions were the same as Example 3 with the exception of hot plate temperature and draw ratio which were 480° C. and 8× respectively.

The drawn fibre produced had the following properties:

Tenacity (g/decitex): 10.0
Extension (%): 4.4
Initial Modulus (g/decitex): 300
Inherent Viscosity: 1.7

Table 4 lists other polyoxadiazole dopes which were prepared by a similar method to that described in Example 14. The usage of iodine catalyst and bromine in the bromination of the terephthalic acid component prior to addition of isophthalic acid and hydrazine sulphate and polymerisation are given. The Table also gives the properties of drawn fibres obtained by spinning the dopes and hot drawing the fibre at the indicated temperatures and draw ratio, spinning and hot drawing being carried out by similar procedures to that described in Example 3.

TABLE 4

| Example | Brominated Polyoxadiazole Composition TA/iPA(mole) % | Brominating Intermediates Iodine (g) | Bromine (g) | Polymer Analysis IV | % Br | Spinning Temp. °C. | Hot Drawing Temp °C. | Draw Ratio | Hot Drawn Fibre Properties T | E | M | IV |
|---|---|---|---|---|---|---|---|---|---|---|---|---|
| 15 | 50/50 | 0.5 | 68.6 | 2.7 | 11.7 | 187 | 440 | 17 | 7.0 | 7.9 | 200 | 2.3 |
| 16 | 60/40 | 0.75 | 102.9 | 2.6 | 16.9 | 155 | 450 | 14 | 7.5 | 6.5 | 210 | 2.3 |
| 17 | 70/30 | 1.0 | 137.3 | 1.9 | 19.6 | 120 | 450 | 16 | 7.2 | 4.3 | 240 | 1.9 |
| 18 | 80/20 | 0.75 | 152.8 | 2.5 | 21.9 | 190 | 455 | 10 | 9.3 | 5.4 | 265 | 2.2 |
| 19 | 80/20 | 0.75 | 116.7 | 2.3 | 17.3 | 180 | 495 | 12 | 9.2 | 4.5 | 360 | 2.3 |

TABLE 4-continued

| Example | Brominated Polyoxadiazole Composition TA/iPA(mole) % | Brominating Intermediates Iodine (g) | Brominating Intermediates Bromine (g) | Polymer Analysis IV | Polymer Analysis % Br | Spinning Temp. °C. | Hot Drawing Temp °C. | Hot Drawing Draw Ratio | Hot Drawn Fibre Properties T | E | M | IV |
|---|---|---|---|---|---|---|---|---|---|---|---|---|
| 20 | 95/5 | 1.0 | 174.7 | 1.8 | 23.2 | 92 | 518 | 9 | 8.6 | 3.2 | 365 | 1.6 |

TA = Terephthalic Acid
iPA = Isophthalic Acid
IV = Inherent Viscosity
T = Tenacity (g/decitex)
E = Extension (%)
M = Initial Modulus (g/decitex)

EXAMPLE 21

A polyoxadiazole dope was prepared from 2-bromo terephthalic acid (183.75 parts) and hydrazine sulphate (101.6 parts) in oleum (794.5 parts, initial strength 30%) by a similar procedure to that used in Example 3, dilution during the polymerisation process being effected by the addition of 24% oleum (360 parts). A viscous pale brown dope was obtained. Polymer isolated from the dope had an inherent viscosity of 2.4 and contained 32.8% bromine.

The dope was degassed and spun at 193° C. by a similar method to that described in Example 3. The fibre was drawn at 510° C., at a draw ratio of 6 to give yarn with properties:

Tenacity: 6.4
Extension (%): 9.4
Initial Modulus (g/decitex): 211

EXAMPLE 22 AND COMPARATIVE EXAMPLE E

These examples illustrate the advantage of a heat treatment immediately prior to drawing if the filament has not been dried or dried properly and still contains moisture.

A brominated polyoxadiazole copolymer of 2.2 IV made from 80 parts terephthalic acid and 20 parts isophthalic acid with 17% bromine on the para-phenylene radicals, is dry jet wet spun from a 7.5% concentration solution in oleum into a cold aqueous coagulation bath with spin stretch factor 1 and subsequently washed free of acid, dried at constant length and oiled to give a 10 filament yarn of 550 dtex.

The dried spun yarn is fed to a cold pretension roll and then with a 1.09 prestretch ratio onto a feed roll with separator at ambient temperature. The drawn yarn is collected after 12 turns on the draw roll and separator by a tension controlled wind up. The diameter of the feed and draw roll is 10 cm and the feedspeed is maintained constant at 10 m/min. The optimum hot plate temperature was found to be 495° C. for this yarn.

The same drawing process is applied to the spun yarn used for Example E with the exception that the feed roll is heated to 250° C. No major dimensional changes are apparent as the yarn touches the hot plate and the drawing of the yarn is stable. Moreover microscopic examination of the drawn filaments show them to be transparent and free of voiding.

EXAMPLE E

Using a cold feed roll the spun yarn exhibits sudden dimensional changes with the filaments swelling and flaring away from the hot plate surface and each other. This gives poor drawing process stability and frequent breaks throughout the range of draw ratios. Furthermore microscopic examination of the drawn filaments produced particularly up to draw ratio 7× are opaque voided networks which fibrillate easily.

EXAMPLE 23

This example demonstrates the desirable preheating temperature range prior to hot drawing of a filament containing moisture.

A similar brominated polyoxadiazole copolymer to Example 22 but with IV 1.7 and made from 90 parts terephthalic acid and 10 parts isophthalic acid with 22% bromine on the para-phenylene radicals is converted to spun yarn as described in Example 1.

The spun yarn was drawn 8 times by the process described in Example 1 over a range of hot roll temperatures from 150° C. to 325° C. Samples of the yarn were collected just after the hot roll and after contact with the hot plate and examined under a microscope. No bubbles were seen in samples from the hot roll up to a temperature of 270° C. but with a rapid increase in size and frequency up to 325° C. The samples from the hot plate showed an increase in bubbles on samples pretreated at 190° C. or lower but no change in those preheated at higher temperatures. Thus pretreatments in the range 190° C.–270° C. showed no "foaming" during drawing. Observation of the drawing process stability also indicated that the most desirable pretreatment was in this temperature range.

MEASUREMENT OF TENSILE PROPERTIES

Decitex was determined by weighing 25 cm lengths of the yarn on a torsion balance. The breaking load, estension and load at 1% extension were measured over a 10 cm length of the decitex samples at an extension rate of 10% per minute using an Instron 3B with pneumatic action jaws (catalogue ref. 2712/002) rubber coated.

EXAMPLES 24, 25 AND 26, AND COMPARATIVE EXAMPLE F

These Examples illustrate the effect of stretching filaments whilst they are in the wet, never-dried state.

A copolymer was prepared by brominating a polyphenylene-1,3,4-oxadiazole formed from a mixture of terephthalic and isophthalic acids in the ratio of 90:10 according to the method described in Example 1. The polymer had a bromine content of 23% by weight, and an IV of 1.6 (98% sulphuric acid). The polymer, in the form of a 10% wt/wt solution in oleum was degassed and dry jet wet spun through a 10×200μ spinneret at a jet velocity of 15 m. per minute through a 1 cm air gap into a coagulation bath of water at a temperature of 10° C. The filaments were then washed free of acid by passing them over rolls at 15 m. per minute through a series of water baths heated to 60° C.

Directly afterwards, the washed filaments were passed through a water bath 50 cm. in length and heated to a temperature of 90° C. The filaments were then passed around a pin having a diameter of 5 cm. and immersed in the water bath, over drying rolls heated to a temperature of 160° C., oiled, and wound up. The extent of stretching which occurred whilst the filaments were wet was measured by dividing the drying roll speed by the wash roll speed.

Finally the filaments were prestretched 1.05 times, passed around a feed roll heated to a temperature of 250° C. and drawn over a one meter long hot plate heated to a temperature of 460° C. The feed roll speed was 10 m. per. minute. Properties of the resulting filaments are given in the table below.

TABLE 5

| Example | Stretch Ratio of Wet Filaments | Properties of filaments before hot drawing: Tenacity gp d'tex | Extn. % | Modulus gp d'tex | Draw Ratio at 460° C. | Total Elongation | Properties of filaments after hot drawing: Tenacity gp d'tex | Extn. % | Modulus gp d'tex |
|---|---|---|---|---|---|---|---|---|---|
| 24 | 1:1 | 0.85 | 210 | 20 | 9.5:1 | 9.5:1 | 10.7 | 3.3 | 420 |
| 25 | 1.75:1 | 1.51 | 110 | 36 | 5.9:1 | 10.3:1 | 11.0 | 3.3 | 430 |
| 26 | 2.5:1 | 2.22 | 50 | 55 | 3.5:1 | 8.8:1 | 9.6 | 3.2 | 402 |
| Comparative F | 1:1 | 0.85 | 210 | 20 | 5.9:1 | 5.9:1 | 7.4 | 3.4 | 330 |

In the following Examples, Examples 27 and 28 illustrate the effect of hot drawing alone, Examples 29 to 32 the effect of a combination of dry stretching at 20° C. and hot drawing, Examples 33 to 38 the effect of a combination of wet stretching at 94° C., dry stretching at 20° C., and hot drawing, and Examples 39 and 40 the effect of a combination of wet stretching and hot drawing.

A brominated polyphenylene-1,3,4-oxadiazole was prepared by the method described in Example 1, the ratio of p-phenylene radicals to m-phenylene radicals being 70/30 and the bromine content 19.2%. The polymer solution was spun into filaments as described in Example 1. In some examples the washed, coagulated filaments were stretched in a water bath maintained at 94° C. before the filaments were dried, and in some the dried filaments were stretched at a temperature of 20° C. before being heated to a temperature above 350° C. for hot drawing. Further details of the stretching processes employed and the properties of the resulting filaments are given in Table 6.

The glass transition temperature of the dried polyoxadiazole filaments may be determined by use of a Perkin-Elmer differential scanning calorimeter, model DSC-2. The sample was swept with nitrogen whilst being heated at a rate of 80° C. per minute. Onset of the step-wise change in the base line was taken as the transition temperature. Corrections for the instrumental time lag and temperature scale non-linearity were applied.

TABLE 6

| Example | Extent of Stretching: Wet at 94° C. | Dry at 20° C. | Hot | Temp (°C.) for Hot Stretch | Total | Properties of Drawn Filament: Tenacity (g/d'tex) | Extension to Break (%) | Initial Modulus (g/d'tex) |
|---|---|---|---|---|---|---|---|---|
| 27 | 1 | 1 | 9.9 | 408 | 9.9 | 10.5 | 5.3 | 325 |
| 28 | 1 | 1 | 10.1 | 408 | 10.1 | 11.3 | 5.0 | 350 |
| 29 | 1 | 1.5 | 7.0 | 402 | 10.5 | 10.1 | 5.0 | 336 |
| 30 | 1 | 2.0 | 4.9 | 401 | 9.8 | 9.5 | 5.3 | 309 |
| 31 | 1 | 2.5 | 4.1 | 401 | 10.2 | 10.1 | 5.3 | 328 |
| 32 | 1 | 3.0 | 3.3 | 404 | 9.9 | 8.7 | 5.2 | 306 |
| 33 | 1.3 | 1.0 | 7.8 | 407 | 10.2 | 10.1 | 5.3 | 319 |
| 34 | 1.3 | 1.5 | 4.9 | 400 | 9.8 | 10.6 | 5.3 | 342 |
| 35 | 1.3 | 2.0 | 4.9 | 400 | 10.6 | 9.9 | 5.0 | 335 |
| 36 | 1.5 | 1.0 | 6.6 | 406 | 9.9 | 10.3 | 5.2 | 319 |
| 37 | 1.5 | 1.5 | 4.5 | 402 | 10.2 | 9.8 | 5.0 | 328 |
| 38 | 1.5 | 2.0 | 3.3 | 394 | 9.9 | 9.1 | 4.8 | 319 |
| 39 | 2.0 | 1.0 | 5.1 | 400 | 10.2 | 10.6 | 4.9 | 345 |
| 40 | 2.5 | 1.0 | 3.9 | 403 | 9.8 | 9.6 | 5.0 | 316 |

What we claim is:

1. A method for the production of a drawn filament of polyphenylene-1,3,4-oxadiazole which comprises (a) extruding through a shaped orifice a solution of the polymer in oleum or sulphuric acid, the polymer having as characteristic units

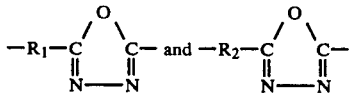

in which $R_1$ is a p-phenylene radical, and $R_2$ is a m-phenylene radical, the ratio of $R_1$ radicals to $R_2$ radicals lying within the range 100/0 to 50/50, at least some of the phenylene radicals being bromine substituted in a position ortho to the heterocyclic ring, the bromine content of the polymer being at least T%/6 where T is the mole percent of p-phenylene radicals, (b) passing the extruded polymer solution through a gaseous medium for a short distance, and then into an aqueous coagulant to form an undrawn, filament of the polymer, (c) and stretching the undrawn filament at least six times its length, the filament being stretched at least two times while heated to a temperature of at least 350° C.

2. A method according to claim 1 wherein the undrawn filament is subjected to a single stretching operation while heated to a temperature of at least 350° C.

3. A method according to claim 1 wherein the undrawn filament is subjected to a plurality of stretching operations, the undrawn filament being stretched whilst in a wet state during one of the operations.

4. A method according to claim 1 wherein the undrawn filament is subjected to a plurality of stretching operations, the filament being dried and stretched at a temperature below the Tg of the filament during one of the operations.

5. A method according to claim 1 wherein the ratio of $R_1$ radicals to $R_2$ radicals lies within the range 95/5 to 70/30.

6. A method according to claim 1 wherein the undrawn filament is stretched at least 2 times while heated to a temperature of at least 400° C.

7. A method according to claim 1, wherein the undrawn filament is dried by being heated at a temperature in the range 140° C. to 300° C. immediately prior to stretching at least two times at 350° C.

8. A method according to claim 1, wherein the filament is stretched while being coagulated.

9. A method according to claim 1, wherein the bromine content of the polymer is at least (T/5)+5%.

10. A method for production of a drawn filament of polyphenylene-1,3,4-oxadiazole which comprises (a) extruding through a shaped orifice a solution of the polymer in oleum or sulphuric acid, the polymer having as characteristic units

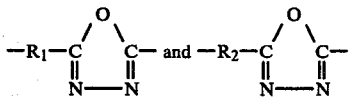

in which $R_1$ is a p-phenylene radical, and $R_2$ is a m-phenylene radical, the ratio of $R_1$ radicals to $R_2$ radicals lying within the range 100/0 to 50/50, at least some of the phenylene radicals being bromine substituted in a position ortho to the heterocyclic ring, the bromine content of the polymer being at least T/6% where T is the mole percent of p-phenylene radicals, (b) passing the extruded polymer solution through a gaseous medium for a short distance, and then into an aqueous coagulant to form an undrawn filament of the polymer, (c) withdrawing the thus-formed filament from the aqueous coagulant, (d) washing the filament, (e) stretching the filament, (f) drying the stretched and washed filament, and (g) drawing the filament while heated to a temperature of at least 350° C. at a draw ratio of at least 2:1, steps (d) and (e) being performed in any order, and the combined stretching of step (e) and drawing of step (g) causing the undrawn filament to be elongated at least 6 times.

11. A method for the production of a drawn filament of polyphenylene-1,3,4-oxadiazole which comprises (a) extruding through a shaped orifice a solution of the polymer in oleum or sulphuric acid, the polymer having as characteristic units

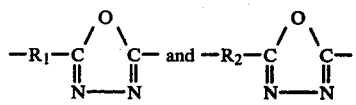

in which $R_1$ is a p-phenylene radical, and $R_2$ is a m-phenylene radical, the ratio of $R_1$ radicals to $R_2$ radicals lying within the range 100/0 to 50/50, at least some of the phenylene radicals being bromine substituted in a position ortho to the heterocyclic ring, the bromine content of the polymer being at least T/6 % where T is the mole percent of p-phenylene radicals, (b) passing the extruded polymer solution through a gaseous medium for a short distance, and then into an aqueous coagulant to form an undrawn filament of the polymer, (c) withdrawing the thus-formed filament from the aqueous coagulant, (d) washing the filament, (e) drying the washed filament, (f) stretching the dried filament while heated to a temperature below Tg of the filament, and (g) drawing the filament while heated to a temperature of at least 350° C. at a draw ratio of at least 2:1, the combined stretching of stage (f) and drawing of stage (g) causing the undrawn filament to be elongated at least 6 times.

12. A method for the production of a drawn filament of polyphenylene-1,3,4-oxadiazole which comprises (a) extruding through a shaped orifice a solution of the polymer in oleum or sulphuric acid, the polymer having as characteristic units

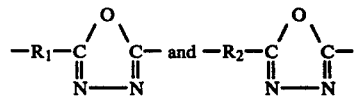

in which $R_1$ is a p-phenylene radical, and $R_2$ is a m-phenylene radical, the ratio of $R_1$ radicals to $R_2$ radicals lying within the range 100/0 to 50/50, at least some of the phenylene radicals being bromine substituted in a position ortho to the heterocyclic ring, the bromine content of the polymer being at least T/6 % where T is the mole percent of p-phenylene radicals, (b) passing the extruded polymer solution through a gaseous medium for a short distance, and then into an aqueous coagulant to form an undrawn filament of the polymer, (c) withdrawing the thus formed filament from the aqueous coagulant, (d) washing the filament, (e) stretching the filament, (f) drying the washed and stretched filament, (g) stretching the dried filament while heated to a temperature below the Tg of the filament, and (h) drawing the filament while heated to a temperature of at least 350° C. at a draw ratio of at least 2:1, steps (d) and (e) being performed in any order, and the combined stretching of steps (e) and (g) and drawing of step (h) causing the undrawn filament to be elongated at least 6 times.

* * * * *